US005090143A

United States Patent [19]

Schier et al.

[11] Patent Number: 5,090,143

[45] Date of Patent: Feb. 25, 1992

[54] POSTER HANGING DEVICE

[76] Inventors: R. Clark Schier, 1F Quiet Stream Ct., Timonium, Md. 21093; Sylvia A. Bethea, 341 E. Washington, Howell, Mich. 48843

[21] Appl. No.: 158,799

[22] Filed: Feb. 22, 1988

[51] Int. Cl.[5] ..... G09F 1/12

[52] U.S. Cl. ..... 40/152.1; 40/603

[58] Field of Search ..... 40/152, 152.1, 155, 40/603, 604

[56] References Cited

U.S. PATENT DOCUMENTS

| | | | |
|---|---|---|---|
| 1,705,052 | 3/1929 | Viscount | 40/603 |
| 1,873,178 | 8/1932 | Bernstein | 40/603 |
| 2,099,538 | 11/1937 | Schultz | 40/152 |
| 2,514,047 | 7/1950 | Goforth | 40/152 |
| 2,632,971 | 3/1953 | Manczek et al. | 40/152.1 |
| 2,661,560 | 12/1953 | Malby | 40/152.1 |
| 3,849,920 | 11/1974 | Trowbridge | 40/209 |
| 3,899,843 | 8/1975 | Doyle et al. | 40/603 |
| 3,914,892 | 10/1975 | Mohr | 40/152 |
| 4,014,119 | 3/1977 | Teufel | 40/152 |
| 4,019,270 | 4/1977 | Trowbridge | 40/155 |
| 4,373,279 | 2/1983 | Abel et al. | 40/152.1 |
| 4,426,800 | 1/1984 | Brown | 40/603 |
| 4,490,934 | 1/1985 | Knapp | 40/603 |
| 4,592,158 | 6/1986 | Seely | 40/603 |

*Primary Examiner*—Gene Mancene
*Assistant Examiner*—Michael Lynch
*Attorney, Agent, or Firm*—Gifford, Groh, Sprinkle, Patmore and Anderson

[57] ABSTRACT

A device is disclosed for hanging posters or the like on walls. The device includes a plurality of corner pieces wherein one corner piece is secured to each corner of the poster. One end of an elongated strut is detachably secured to each corner piece while the other ends of the struts are secured to a center support. The struts thus hold the poster in a flat condition and ready to be hung on a wall. The length of the struts is adjustable by the user in order to accommodate different sized posters.

8 Claims, 1 Drawing Sheet

POSTER HANGING DEVICE

BACKGROUND OF THE INVENTION

I. Field of the Invention

The present invention relates to a device for hanging flexible sheets, such as posters.

II. Description of the Prior Art

There are many different previously known ways for hanging posters or other flexible sheets on walls. All of these previously known methods, however, suffer certain disadvantages.

For example, one previously known method for hanging a poster on a wall is to simply tape the corners of the poster to the wall. This, however, disadvantageously damages the wall as well as the poster.

In a different previously known method for hanging a poster on a wall, the poster is sandwiched between a sheet of glass and a sheet of cardboard and the entire assembly is hung on a wall. This method, however, is disadvantageously expensive and, in view of the glass, dangerous for children and adolescents.

Still other methods for hanging posters are expensive and/or difficult to accomplish.

SUMMARY OF THE PRESENT INVENTION

The present invention provides a device for hanging posters or the like which overcomes all of the disadvantages of the previously known devices.

In brief, the device of the present invention comprises a plurality of corner pieces wherein one corner piece is attached to each corner of the poster. Any conventional means, such as glue, can be used to attach the corner pieces to the poster.

One elongated and rigid strut is associated with each corner piece. One end of each strut is nested within a recess in its associated corner piece while the other ends of the struts are secured to a center support so that the struts extend outward from the center support to each corner of the poster. The struts thus hold the poster in a flat condition so that it can be hung on the wall by attaching the center support to the wall in any conventional fashion.

In the preferred form of the inention, the length of each strut is user adjustable in order to accommodate different sized posters.

BRIEF DESCRIPTION OF THE DRAWING

A better understanding of the present invention will be had upon reference to the following detailed description of the drawing when read in conjunction with the accompanying drawing, wherein like reference characters refer to like parts throughout the several views, and in which.

DETAILED DESCRIPTION OF PREFERRED EMBODIMENTS OF THE INVENTION

Figure 1:
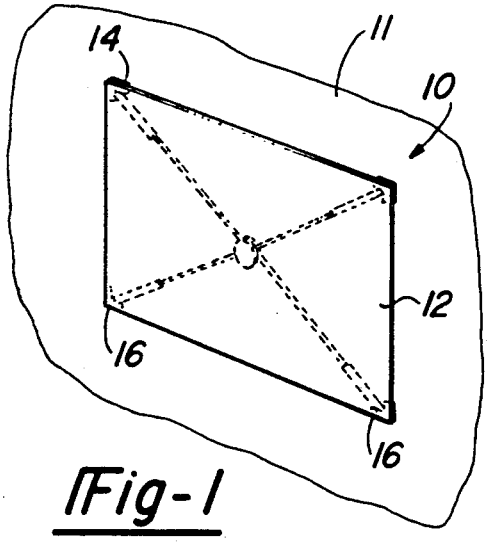
FIG. 1 is a front perspective view illustrating a preferred embodiment of the invention.
Figure 2:
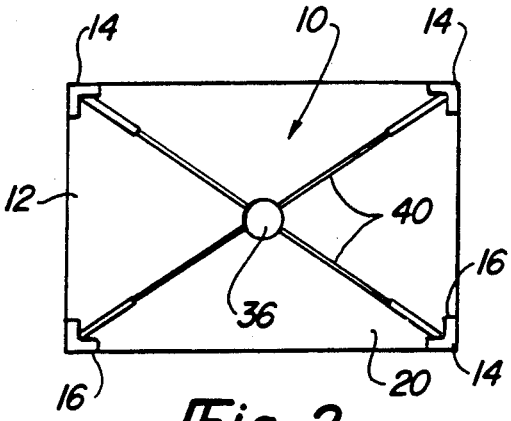
FIG. 2 is a back plan view of the preferred embodiment.

With reference first to FIGS. 1 and 2, a preferred embodiment of the device 10 of the present invention for hanging a poster 12 on a wall is thereshown. Although the device 10 will be described for use with hanging a poster 12 on a wall, it will be understood that the device 10 can alternatively be used for hanging other types of flexible sheets on a wall 11 or the like.

Figure 4:
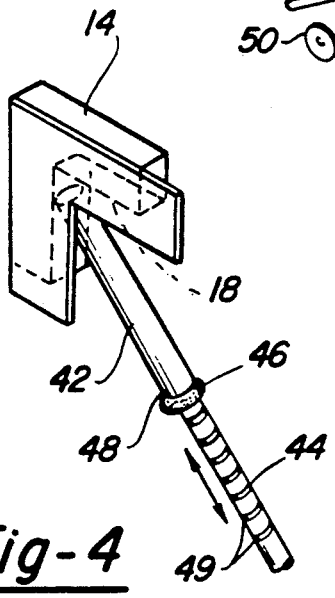
FIG. 4 is a fragmentary view illustrating a portion of the preferred embodiment.

Still referring to FIGS. 1 and 2, the device 10 generally comprises a plurality of corner pieces 14 where one corner piece is attached to each corner 16 of the poster 12. As best shown in FIG. 4, each corner piece 14 includes a recess 18 facing the center of the poster 12 for a reason to be subsequently described.

Preferably, each corner piece 14 is attached to their respective corner 16 on the rear side 20 of the poster 12 by glue 22.

Figure 6:
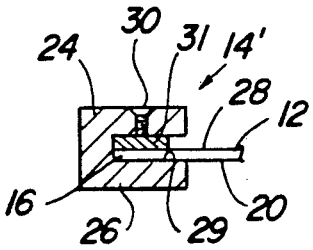
FIG. 6 is a sectional view illustrating an alternate form for the corner piece.

An alternative embodiment of the the corner piece 14' is shown in FIG. 6 in which the corner piece 14' comprises two generally planar members 24 and 26 which are attached together and respectively disposed on the front side 28 and rear side 20 of the poster 12. A slot 29 is formed between the members 24 and 26 and the corner 16 of the poster 12 is disposed in the slot 29. Screws 30 threadably engage the corner piece members 24 and abut against a plate 31 in the slot 29. Upon tightening of the screws 30, the screws 30 clampingly compress the plate 31 and poster corner 16 together to thereby attach the corner piece 14' to the poster 16.

Other means for attaching the corner pieces 14 to the poster can alternatively be used.

Figure 5:
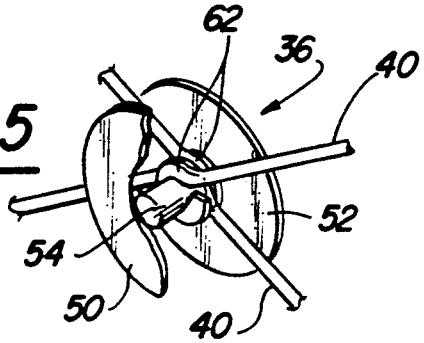
FIG. 5 is a fragmentary view illustrating a different portion of the preferred embodiment.

Referring now to FIGS. 2 and 5, the device 10 of the present invention includes a center support 36 positioned near the midpoint of the rear side 20 of the poster 12. One elongated and stiff strut 40 extends from the center support 36 to each corner piece 14 and, in doing so, the struts 40 hold the poster 12 in a generally flat condition. The construction of the center support 36 will be subsequently described.

Referring now to FIG. 4, the strut 40 is thereshown in greater detail and comprises an elongated tube 42 which telescopically receives an elongated rod 44. A resilient ring 46, such as an O-ring, is disposed around the rod 44 and abuts against one end 48 of the tube 42. The ring 46 is dimensioned so that it compressibly and frictionally engages the rod 44 but can be slid along the rod 44 by the user.

In practice, the overall longitudinal length of the strut 40 is adjustable by sliding the resilient ring 46 along the rod 44 so that the ring abuts the tube 42 at different telescopic positions of the rod 44 and tube 42, thereby effectively locking the rod 44 and tube 42 together at an adjusted position of the length of the strut 40. Furthermore, the rod 44 preferably includes a plurality of spaced apart, circumferential recesses 49 dimensioned to nestingly receive the O-ring 46 to enhance the locking action of the O-ring 46 with respect to the rod 44 and tube 42.

Figure 3:
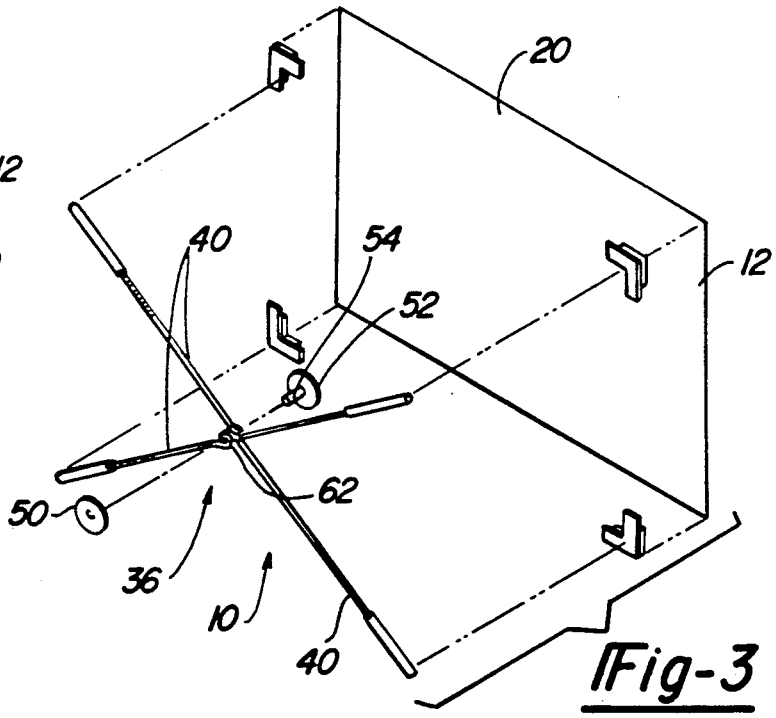
FIG. 3 is an exploded view of the preferred embodiment.

With reference now to FIGS. 3 and 5, the center support 36 comprises two generally planar housing parts 50 and 52 which are spaced apart and generally planar to each other. A post 54 extends between and secures the housing parts 50 and 52 together. Any conventional means, such as a threaded connection between the free end of the post 54 and one housing part 50 or 52, can be used to secure the housing parts 50 and 52 together.

A flattened loop 62 having thickness about one quarter the diameter of the rod 44 is formed at the inner end of each strut 40 which encircles the post 54 and attaches the inner end of the strut 40 to the center support 36. Preferably, the housing parts 50 and 52 clampingly engage the rods 44. Conversely, the outer end of each strut 40 is nested within the recess 18 on its associated corner piece 14.

In practice, the length of the struts 40 is adjusted by adjusting the telescopic position of the rods 44 with respect to their associated tubes 42 as well as the rings 46 until the poster 12 is flatly held by the struts 40, corner pieces 14 and center support 36. Thereafter, the center support 36 can be hung on a wall or the like by any conventional means, such as a hook.

Having described our invention, many modifications thereto will become apparent to those skilled in the art to which it pertains without deviation from the spirit of the invention as defined by the scope of the appended claims.

We claim:

1. A device for mounting a flexible sheet, said flexible sheet having at least three spaced apart corners, said apparatus comprising:

a center support, a plurality of corner pieces, each corner piece having a recess, means for securing one corner piece to each corner of the sheet so that each corner piece is immovable with respect to its associated corner of the flexible sheet and so that the recess on each corner piece faces towards a center of the flexible sheet, a plurality of elongated struts, said struts being separate from and unattached to said corner pieces, means for attaching on end of each strut to said center support, wherein the other end of each strut rests within the recess of one of said corner pieces, and wherein said struts are dimensioned so that said struts exert an outward force on said corner pieces to thereby maintain the flexible sheet in a flat condition, wherein each strut comprises means for adjusting the longitudinal length of said strut, wherein each strut comprises:

an elongated tube, an elongated rod, said rod being telescopically received in said tube, and means for locking said rod to said tube at a user selected position, wherein said locking means comprises a resilient ring disposed around said rod and abutting against one end of said tube, said ring being dimensioned so that it compressibly and frictionally engages said rod.

2. The invention as defined in claim 1 wherein said rod includes a plurality of longitudinally spaced apart notches, said notches being dimensioned to nestingly receive said ring.

3. The invention as defined in claim 1 wherein said means for attaching one end of each strut to said center support comprises:

a loop formed on said one end of each strut, said center support comprising two spaced apart body parts and a post extending between said body parts, and means for detachably securing said body parts together so that said post extends through said loops.

4. The invention as defined in claim 1 wherein said means for mounting one corner piece to each corner of the sheet comprises a glue layer between said sheet and said corner piece.

5. The invention as defined in claim 1 wherein said means for mounting one corner piece to each corner of the sheet comprises means for clamping said corner piece to said sheet.

6. The invention as defined in claim 5 wherein each corner piece comprises two generally planar members, said members being disposed on opposite sides of said sheet, and wherein said clamping means comprises means for compressing said members together.

7. The invention as defined in claim 1 wherein the sheet is generally rectangular and comprising four corner pieces and four struts.

8. A device for mounting a flexible sheet, said flexible sheet having at least three spaced apart corners, said apparatus comprising:

a center support, a plurality of corner pieces, each corner piece having a recess, means for securing one corner piece to each corner of the sheet so that each corner piece is immovable with respect to its associated corner of the flexible sheet and so that the recess on each corner piece faces towards a center of the flexible sheet, a plurality of elongated struts, said struts being separate from and unattached to said corner pieces, means for attaching one end of each strut to said center support, wherein the other end of each strut rests within the recess of one of said corner pieces, and wherein said struts are dimensioned so that said struts exert an outward force on said corner pieces to thereby maintain the flexible sheet in a flat condition, wherein said means for attaching one end of each strut to said center support comprises:

a loop formed on said one end of each strut said center support comprising two spaced apart body parts and a post extending between said body parts, and means for detachably securing said body parts together so that said post extends through said loops.

* * * * *